US008167970B2

(12) United States Patent
Chen et al.

(10) Patent No.: US 8,167,970 B2
(45) Date of Patent: May 1, 2012

(54) METHOD FOR PURIFYING AL-TI-B ALLOY MELT

(75) Inventors: Xuemin Chen, Guangdong (CN); Qingdong Ye, Guangdong (CN); Jianguo Li, Guangdong (CN); Chaowen Liu, Guangdong (CN); Yueming Yu, Guangdong (CN)

(73) Assignee: Shenzhen Sunxing Light Alloys Materials Co., Ltd., Shenzhen, Guangdong (CN)

( * ) Notice: Subject to any disclaimer, the term of this patent is extended or adjusted under 35 U.S.C. 154(b) by 85 days.

(21) Appl. No.: 12/867,200

(22) PCT Filed: May 10, 2010

(86) PCT No.: PCT/CN2010/072559

§ 371 (c)(1),
(2), (4) Date: Aug. 11, 2010

(87) PCT Pub. No.: WO2011/022986

PCT Pub. Date: Mar. 3, 2011

(65) Prior Publication Data

US 2011/0192253 A1 Aug. 11, 2011

(30) Foreign Application Priority Data

Feb. 5, 2010 (CN) ..... 2010 1 0110046

(51) Int. Cl.
*C22B 4/00* (2006.01)
*C22B 21/06* (2006.01)

(52) U.S. Cl. ..... 75/10.18; 75/10.54; 75/685

(58) Field of Classification Search ..... 75/10.18, 75/10.54, 685

See application file for complete search history.

(56) References Cited

U.S. PATENT DOCUMENTS 4,983,216 A * 1/1991 Van Linden et al. ..... 75/672
6,454,832 B1 * 9/2002 Verdier et al. ..... 75/353

OTHER PUBLICATIONS

English translation of Japanese Kokai Patent Publication No. S49-17133, published Apr. 27, 1974.*

* cited by examiner

*Primary Examiner* — George Wyszomierski
*Assistant Examiner* — Tima M McGuthry Banks
(74) *Attorney, Agent, or Firm* — Jackson IPG PLLC; Demian K. Jackson

(57) ABSTRACT

A method for purifying Al—Ti—B) alloy melt includes putting and melting industrial aluminum ingot in an electromagnetic induction smelting furnace, the melt of Al being covered by a high-temperature covering agent, and its temperature up to at about 670~900° C.; adding material of $K_2TiF_6$ and $KBF_4$ into the smelting furnace and then stirring the compounds therein to react; adding compound comprising Mg, L, Na and F to the evenly stirred $K_2TiF_6$ and $KBF_4$, the compound having an amount about 0.01%~1% of a sum weight of total $K_2TiF_6$ and $KBF_4$, and uniformly stirring for about 15~60 minutes under a reaction temperature being constantly at about 670~900° C., the dregs being removed, the Al alloy being casting molded.

5 Claims, No Drawings

METHOD FOR PURIFYING AL-TI-B ALLOY MELT

This application is 371 of PCT/CN2010/072559 filed 05/10/2010.

The present invention relates to methods for alloy materials fabrication, especially to a method for purifying Al(aluminum) -Ti(titanium) -B (boron) alloy melt.

GENERAL BACKGROUND

Currently, Al—Ti—B alloy basically employ materials of K2TiF6+KBF4 as additive materials for Ti—B elements, and during a reaction processing, a reaction product of mKF·AlF3 is likely to form into macromolecular compounds and mix with Al(TiB2+TiAl3) which causes it hard to be separated out. In this case, a purify degree and a refinement ability are extensively deceased. In traditional fabrication processes, it has been a problem to find a solution for separating the macromolecular reaction product of mKF·AlF3 out of the Al(TiB2+TiAl3) alloy for long.

Huge potential safety hazards could be brought out to Al and Al alloy materials when dregs like mKF·AlF3 distributed in the Al(TiB2+TiAl3) alloy are not eliminated effectively or keep down to a certain amount, and the Al(TiB2+TiAl3) alloy with such dregs are still used as additives for refining of crystal grains of Al and Al alloy. If the Al and Al alloy with such dregs of mKF·AlF3 are used for fabrication of Al plates of plane wings, where the dregs located are likely to become inducement points of mangling due to a low temperature and a high pressure in flight.

What is needed, therefore, is a method for purifying Al—Ti—B alloy that can overcome or mitigate the above-described deficiencies.

SUMMARY

It is an object of the present invention to provide a method for purifying Al—Ti—B alloy.

One exemplary embodiment of the present invention is a method for purifying Al-Ti-B) alloy includes putting and melting industrial aluminum ingot in an electromagnetic induction smelting furnace, the melt of Al being covered by a high-temperature covering agent, and its temperature up to at about 670~900° C.;adding material of $K_2TiF_6$ and $KBF_4$ into the smelting furnace and then stirring the compounds therein to react; adding compound comprising Mg, L, Na and F to the evenly stirred $K_2TiF_6$ and $KBF_4$, the compound having an amount about 0.01%~1% of a sum weight of total $K_2TiF_6$ and $KBF_4$, and uniformly stirring for about 15~60 minutes under a reaction temperature being constantly at about 670~900° C., the dregs being removed, the Al alloy being casting molded.

Other novel features and advantages will become more apparent from the following detailed description when taken in conjunction with the accompanying drawings.

DETAILED DESCRIPTION OF PREFERRED EMBODIMENTS

Embodiment 1: Fabrication of Al—Ti—B Alloy

Step A: Industrial aluminum ingot are put into and melted in an electromagnetic induction smelting furnace. After that, the melt of Al is covered by a high-temperature covering agent, and its temperature is at about 700±10° C.

Step B : Material of $K_2TiF_6$ and $KBF_4$ are added into the smelting furnace and then compounds therein are stirred to react in accordance with the following reaction formula:

$$K_2TiF_6 + KBF_4 + Al \xrightarrow{670\sim900^\circ\ C.} Al\,(TiB_2 + TiAl_3) + mKF\bullet nAlF_3$$

In the reaction product of $mKF\cdot nAlF_3$, m+n≦200. In the alloy of Al ($TiB_2$+$TiAl_3$), a proportion of Ti is about 1~5%, a proportion of B is about 0.001~0.5%, and the rest is Al. An amount of $K_2TiF_6$ and $KBF_4$ are determined according to the formula that should ensure a fully reaction. In a normal situation, an amount of $K_2TiF_6$ and $KBF_4$ that should be added into is about 20~40% and 20~60% of a total weight of the Al melt, respectively.

Step C: Mg(magnesium)F(fluorine)$_x$·Li(lithium)F$_y$·Na(sodium)F$_z$ is added. An amount of $MgF_x\cdot LiF_y\cdot NaF_z$ is 0.1% of a sum weight of $K_2TiF_6$ and $KBF_4$. Uniformly stirring for about 15~60 minutes under a reaction temperature being constantly at about 700±10° C., the dregs including $mKF\sim nAlF_3$ are removed thereas, and the Al alloy is casting molded. A whole reaction process has employed at least 3 layers of windings to generate magnetic vibrations. When there are 3 layers of windings, their vibration frequencies are at 50 HZ, 500~1200 HZ, and 1500~2500 HZ, respectively. The reaction process is guaranteed with uniform vibration waves, such that the melt can be uniformly vibrated and groups of grains of $TiB_2$ have an average diameter no more than 2 μm. During the above mentioned reaction process, by adding proper amount of $MgF_x\cdot LiF_y\cdot NaF_z$, a polymerization of $mKF\cdot nAlF_3$ is effectively prevented or at least blocked. Compounds including element K(potassium) has an amount reduced from about 5 g/kg using the traditional processes to 0.01 g/kg using the method for purifying Al—Ti—B alloy of the present invention. Therefore an impurity amount of the after products is extensively decreased.

The product of Al-TiB alloy can used for refining of other Al and Al alloy crystal grains, with an additive amount of 1~5‰, in order to improve the refinement ability of Al and Al alloy crystal grains.

Embodiment 2: Fabrication of Al—Ti—B Alloy

Step A: Industrial aluminum ingot are put into and melted in an electromagnetic induction smelting furnace. After that, the melt of Al is covered by a high-temperature covering agent, and its temperature is at about 750~850° C.

Step B : Material of $K_2TiF_6$ and $KBF_4$ are added into the smelting furnace and then compounds therein are stirred to react in accordance with the following reaction formula:

$$K_2TiF_6 + KBF_4 + Al \xrightarrow{670\sim900^\circ\ C.} Al\,(TiB_2 + TiAl_3) + mKF\bullet nAlF_3$$

In the reaction product of $mKF\cdot nAlF_3$, m+n≦200. In the alloy of Al ($TiB_2$+$TiAl_3$), a proportion of Ti is about 1~5%, a proportion of B is about 0.001~1%, and the rest is Al. An amount of $K_2TiF_6$ and $KBF_4$ are determined according to the formula that should ensure a fully reaction. In a normal situation, an amount of $K_2TiF_6$ and $KBF_4$ that should be added into is about 20~40% and 20~60% of a total weight of the Al melt, respectively.

Step C: $MgF_x \cdot LiF_y \cdot NaF_z$ is added. An amount of $MgF_x \cdot LiF_y \cdot NaF_z$ is 0.5% of a sum weight of $K_2TiF_6$ and $KBF_4$. Uniformly stirring for about 15~60 minutes under a reaction temperature being constantly at about 750~850° C., the dregs are removed thereas, and the Al alloy is casting molded. A whole reaction process has employed at least 3 layers of windings to generate magnetic vibrations. When there are 3 layers of windings, their vibration frequencies are at 50 HZ, 500~1200 HZ, and 1500~2500 HZ, respectively. The reaction process is guaranteed with uniform vibration waves, such that the melt can be uniformly vibrated and groups of grains of $TiB_2$ have an average diameter no more than 2 μm.

During the above mentioned reaction process, by adding proper amount of $MgF_x \cdot LiF_y \cdot NaF_z$, a polymerization of $mKF \cdot nAlF_3$ is effectively prevented or at least blocked. Compounds including element K(potassium) has an amount reduced from about 5 g/kg using the traditional processes to 0.01 g/kg using the method for purifying Al—Ti—B alloy of the present invention. Therefore an impurity amount of the after products is extensively decreased.

The product of Al-TiB alloy can used for refining of other Al and Al alloy crystal grains, with an additive amount of 1~5‰ in order to improve the refinement ability of Al and Al alloy crystal grains.

It is to be understood, however, that even though numerous characteristics and advantages of exemplary and preferred embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for purifying Al(aluminum)—Ti(titanium)—B(boron) alloy melt comprising:

a. putting an industrial aluminum ingot in an electromagnetic induction smelting furnace and melting the ingot, the melt of Al being covered by a high-temperature covering agent, and its temperature up to about 670~900° C.;

b. adding material of $K_2TiF_6$ and $KBF_4$ into the smelting furnace and then stirring the material and the melt of Al to react in accordance with reaction formula of $$K_2TiF_6 + KBF_4 + Al \xrightarrow{670\sim900^\circ C.} Al(TiB_2 + TiAl_3) + mKF \cdot nAlF_3$$

to form a mixture including an alloy of $Al(TiB_2+TiAl_3)$; wherein in the alloy of Al $(TiB_2+TiAl_3)$, a proportion of Ti is about 1~10%, a proportion of B is about 0.001~5%, and the rest is Al; and c. adding compound comprising Mg(magnesium), Li(lithium), Na(sodium) and F(fluorine) to the mixture, the compound having an amount about 0.01%~1% of a sum weight of total $K_2TiF_6$ and $KBF_4$, and uniformly stirring for about 15~60 minutes under a reaction temperature being constantly at about 670~900° C., removing dregs from the alloy, and casting molding the Al alloy.

2. The method for purifying Al—Ti—B alloy melt as claimed in claim 1, wherein the temperature is about 670~850° C. from step a to step c.

3. The method for purifying Al—Ti—B alloy melt as claimed in claim 2, wherein the temperature is about 680~780° C. from step a to step c.

4. The method for purifying Al—Ti—B alloy melt as claimed in claim 3, wherein in step b, a product of the reaction is $mKF \cdot nAlF_3$, wherein $m+n \leqq 200$.

5. The method for purifying Al—Ti—B alloy melt as claimed in claim 4, wherein in the alloy, a proportion of Ti is 1~6%, a proportion of B is 0.001~0.5%, and the rest is Al.

* * * * *